US011034422B2

(12) United States Patent
Myer

(10) Patent No.: US 11,034,422 B2
(45) Date of Patent: Jun. 15, 2021

(54) ELLIPTICAL POWERED WATERCRAFT

(71) Applicant: FREETIME PRODUCTS, LLC, Humboldt, IA (US)

(72) Inventor: Nathan L. Myer, Humboldt, IA (US)

(73) Assignee: Freetime Products, LLC, Humboldt, IA (US)

( * ) Notice: Subject to any disclaimer, the term of this patent is extended or adjusted under 35 U.S.C. 154(b) by 74 days.

(21) Appl. No.: 16/528,912

(22) Filed: Aug. 1, 2019

(65) Prior Publication Data

US 2020/0047864 A1 Feb. 13, 2020

Related U.S. Application Data

(60) Provisional application No. 62/717,422, filed on Aug. 10, 2018.

(51) Int. Cl.
*B63H 16/18* (2006.01)
*B63H 5/02* (2006.01)

(52) U.S. Cl.
CPC ..... *B63H 16/18* (2013.01); *B63H 5/02* (2013.01)

(58) Field of Classification Search
CPC ..... B63H 16/18; B63H 5/02
See application file for complete search history.

(56) References Cited

U.S. PATENT DOCUMENTS

| | | | | |
|---|---|---|---|---|
| 3,132,623 | A * | 5/1964 | Conklin | B63H 5/02 440/26 |
| 5,921,824 | A * | 7/1999 | Ilagan | B63H 16/12 440/26 |
| 6,083,065 | A | 7/2000 | Hall | |
| 6,595,813 | B1 | 7/2003 | Lekhtman | |
| 9,403,585 | B2 | 8/2016 | Arad | |
| 9,481,219 | B2 | 11/2016 | Dovel | |
| 10,441,843 | B2 * | 10/2019 | Ho | A63B 22/0664 |
| 2009/0293790 | A1 * | 12/2009 | Bogard | B63B 3/18 114/61.2 |
| 2016/0059945 | A1 * | 3/2016 | Arad | B63B 1/121 440/23 |
| 2017/0043637 | A1 * | 2/2017 | Dovel | B63H 16/08 |
| 2018/0001986 | A1 * | 1/2018 | Nutz | B63H 20/007 |
| 2018/0178887 | A1 * | 6/2018 | Pacini | B63B 32/70 |
| 2018/0362122 | A1 * | 12/2018 | Duff | B63B 32/45 |

* cited by examiner

*Primary Examiner* — Stephen P Avila
(74) *Attorney, Agent, or Firm* — McKee, Voorhees & Sease, PLC

(57) ABSTRACT

An elliptical powered watercraft includes a buoyant platform, a paddle wheel, pedals operatively connected to the paddle wheel, and a skeg, a fin, or a rudder operatively connected to a steering device, such as handlebars or a steering wheel. An operator propels the elliptical powered watercraft by balancing on the buoyant platform, generating rotational movement with the pedals to deliver power to the paddle wheel, and steering the elliptical powered watercraft by turning the skeg, the fin, or the rudder with the handlebars or the steering wheel.

18 Claims, 5 Drawing Sheets

ELLIPTICAL POWERED WATERCRAFT

CROSS REFERENCE TO RELATED APPLICATIONS

This application claims priority under 35 U.S.C. § 119 to provisional patent application U.S. Ser. No. 62/717,422, filed Aug. 10, 2018. The provisional patent application is herein incorporated by reference in its entirety, including without limitation, the specification, claims, and abstract, as well as any figures, tables, appendices, or drawings thereof.

FIELD OF THE INVENTION

The present invention relates generally to an apparatus and corresponding method of use in the fitness, sporting, recreational, fishing, nautical, transportation, and personal watercraft industries. More particularly, but not exclusively, the present invention relates to an elliptical powered watercraft or floating exercise platform for propelling oneself through a body of water.

BACKGROUND OF THE INVENTION

The background description provided herein gives context for the present disclosure. Work of the presently named inventors, as well as aspects of the description that may not otherwise qualify as prior art at the time of filing, are neither expressly nor impliedly admitted as prior art.

Most known personal watercraft use oars, sails, motors, and/or other artificial forms of propulsion. Recreational human-powered watercraft are used on lakes, rivers, and other larger bodies of water and are often used for exercise or as a means for transportation. Typically, an operator of the watercraft expends his or her own personal energy to propel the watercraft through the water. Examples of recreational human-powered watercraft include, but are not limited to, paddle boards, kayaks, rowboats, and pedal boats. These all carry additional benefits, in that they provide the user with physical exercise.

To propel a paddle board, the operator first balances on the paddle board and places an oar in the water. The operator then rows using both arms. Steering is typically accomplished by moving the oar within the water in a specific direction and may depend on which side of the boat the oar is placed in the water. Because the operator is using his or her feet to balance, his or her arms to row, and his or her brain to make decisions associated with steering, the operator may become easily fatigued. Furthermore, if an operator loses the oars, it may become impossible to steer, and very hard to move, an oar powered watercraft.

One development in the recreational human-powered vehicle industry has resulted in the outdoor elliptical bicycle. The outdoor elliptical bicycle incorporates the best of the elliptical cross trainer and the bicycle. However, this type of technology has yet to transition to the water.

If implemented on the water, this type of technology could benefit businesses such as resorts and exercise clubs having access to bodies of water who can charge hourly or daily for the hourly or daily rental of such recreational human-powered watercraft and even fisherman looking for a more conservative approach to fishing.

While others have tried to develop said technology for the water, these developments have led only to apparatuses that are hard to steer, to propel, and do not provide an acceptable mix of recreation and exercise. Furthermore, these apparatuses often have too many moving parts and become too heavy, making them increasingly expensive, harder to repair, and more difficult to transport from one body of water to another.

Thus, there exists a need in the art for a recreational human-powered watercraft which frees up an operator's hands, does not overly restrict the operator (e.g., a pedal boat), and provides meaningful exercise for the operator.

SUMMARY OF THE INVENTION

Therefore, it is a primary object, feature, and/or advantage of the present invention to improve on or overcome the deficiencies in the art.

It is still yet a further object, feature, or advantage of the present invention to provide a watercraft that allows an operator to store their personal belongings without fear the personal belongings will be damaged by water or will be stolen.

It is still yet a further object, feature, or advantage of the present invention to provide a watercraft that accommodates more than one operator.

It is still yet a further object, feature, or advantage of the present invention to provide a watercraft that conserves fossil fuels.

It is still yet a further object, feature, or advantage of the present invention to provide a watercraft that may be used in a wide variety of applications. For example, the apparatus should aid an operator to exercise, fish, relax, travel to another location, and compete in sporting events.

It is still yet a further object, feature, and/or advantage of the present invention to provide a safe, cost effective, and durable watercraft. For example, lights can be included with the watercraft to help an operator avoid collisions with other objects, especially at night.

It is still yet a further object, feature, and/or advantage of the present invention to provide a watercraft that is aesthetically pleasing. For example, the preferred watercraft is one that is easily cleaned.

It is still yet a further object, feature, and/or advantage of the present invention to practice methods which facilitate use, manufacture, assembly, maintenance, repair, transport, and storage of a watercraft accomplishing some or all of the previously stated objectives.

It is still yet a further object, feature, and/or advantage of the present invention to incorporate the watercraft into a system accomplishing some or all of the previously stated objectives.

The previous objects, features, and/or advantages of the present invention, as well as the following aspects and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part, as would be understood from reading the present disclosure.

According to some aspects of the present disclosure, an elliptical powered watercraft includes a buoyant platform, a paddle wheel, pedals operatively connected to the paddle wheel, and a skeg, a fin, or a rudder operatively connected to handlebars or a steering wheel.

According to some additional aspects of the present disclosure, the elliptical powered watercraft further includes strakes where a hull or a lower surface meets port and starboard sides of the buoyant platform.

According to some additional aspects of the present disclosure, the elliptical powered watercraft further includes a housing encompassing the paddle wheel.

According to some additional aspects of the present disclosure, the buoyant platform includes a raised forward portion or bow.

According to some additional aspects of the present disclosure, the paddle wheel is positioned at an aft portion or stern of the buoyant platform.

According to some additional aspects of the present disclosure, the elliptical powered watercraft further comprises a frame including the handlebars or the steering wheel, a main tube operatively attached to the handlebars or the steering wheel and the skeg, the fin, or the rudder, and a lower tube supporting the main tube.

According to some additional aspects of the present disclosure, the elliptical powered watercraft further includes pedal tubes with upper and lower ends, the lower ends operatively attached to the pedals and the upper ends fixed at a location on the frame.

According to some additional aspects of the present disclosure, the elliptical powered watercraft further includes an upper tube attached to the lower tube and having port and starboard ends which fix the upper ends of the pedal tubes.

According to some additional aspects of the present disclosure, the elliptical powered watercraft further includes forward tubes supporting the main tube.

According to some additional aspects of the present disclosure, the elliptical powered watercraft further includes mounting plates bolted to the buoyant platform and securing the lower tube and the forward tubes to the buoyant platform.

According to some additional aspects of the present disclosure, the elliptical powered watercraft further includes a support structure attached to the forward tubes, the main tube, and the upper tube.

According to some additional aspects of the present disclosure, the elliptical powered watercraft further includes side plates or stride rails attached to the pedals and the pedal tubes and aft, central, and forward bridge linkages adjoining the side plates or stride rails.

According to some additional aspects of the present disclosure, the elliptical powered watercraft further includes a first pivot point associated with the paddle wheel, a second pivot point associated with the pedals, and a crank adjoining the first pivot point and second pivot point and translating kinematic movement from the pedals into rotational movement for the paddle wheel.

According to some additional aspects of the present disclosure, the elliptical powered watercraft further includes a watertight storage compartment, a tackle box, or a well.

According to some additional aspects of the present disclosure, the elliptical powered watercraft further includes cup holders.

According to some additional aspects of the present disclosure, the elliptical powered watercraft further includes a scupper.

According to some additional aspects of the present disclosure, the elliptical powered watercraft further includes lights or LEDs.

According to some additional aspects of the present disclosure, the elliptical powered watercraft further includes a seat.

According to some additional aspects of the present disclosure, the elliptical powered watercraft is adapted for multiple operators.

According to some additional aspects of the present disclosure, the elliptical powered watercraft further includes wheels or tires.

According to some other aspects of the present disclosure, a method of propelling the elliptical powered watercraft described above includes balancing on the buoyant platform, generating rotational movement with the pedals to deliver power to the paddle wheel, and steering the elliptical powered watercraft by turning the skeg, the fin, or the rudder with the handlebars or the steering wheel.

According to some additional aspects of the present disclosure, the method further includes resisting tipping or flipping of the buoyant platform with strakes where a hull or a lower surface meets port and starboard sides of the buoyant platform.

According to some additional aspects of the present disclosure, the method further includes protecting the paddle wheel with a housing.

According to some additional aspects of the present disclosure, the method further includes nullifying rough water or wakes with a raised forward portion or bow of the buoyant platform.

According to some additional aspects of the present disclosure, the method further includes reversing the direction of travel by pedaling backwards.

According to some additional aspects of the present disclosure, the method further includes draining water trapped on a deck or an upper surface of the buoyant platform with a scupper.

According to some additional aspects of the present disclosure, the method further includes illuminating with lights or LEDs the water surrounding the elliptical powered watercraft, a starboard side of the buoyant platform with the color green, a port side of the buoyant platform with the color red, an aft portion or stern of the buoyant platform with the color white, or a storage compartment, a tackle box, or a well of the elliptical powered watercraft.

According to some additional aspects of the present disclosure, the method further includes storing personal belongings in a watertight storage compartment of the elliptical powered watercraft.

According to some additional aspects of the present disclosure, the method further includes removing bait or lures from a tackle box to catch fish.

According to some additional aspects of the present disclosure, the method further includes placing fish in a well of the elliptical powered watercraft.

According to some additional aspects of the present disclosure, the method further includes generates the rotational movement with the pedals to deliver power to the paddle wheel with more than one operator.

According to some other aspects of the present disclosure, a method of transporting the elliptical powered watercraft described above includes rolling the elliptical powered watercraft with wheels or tires on land.

These and/or other objects, features, advantages, aspects, and/or embodiments will be apparent to those skilled in the art after reviewing the following brief and detailed descriptions of the drawings.

Figure 1:
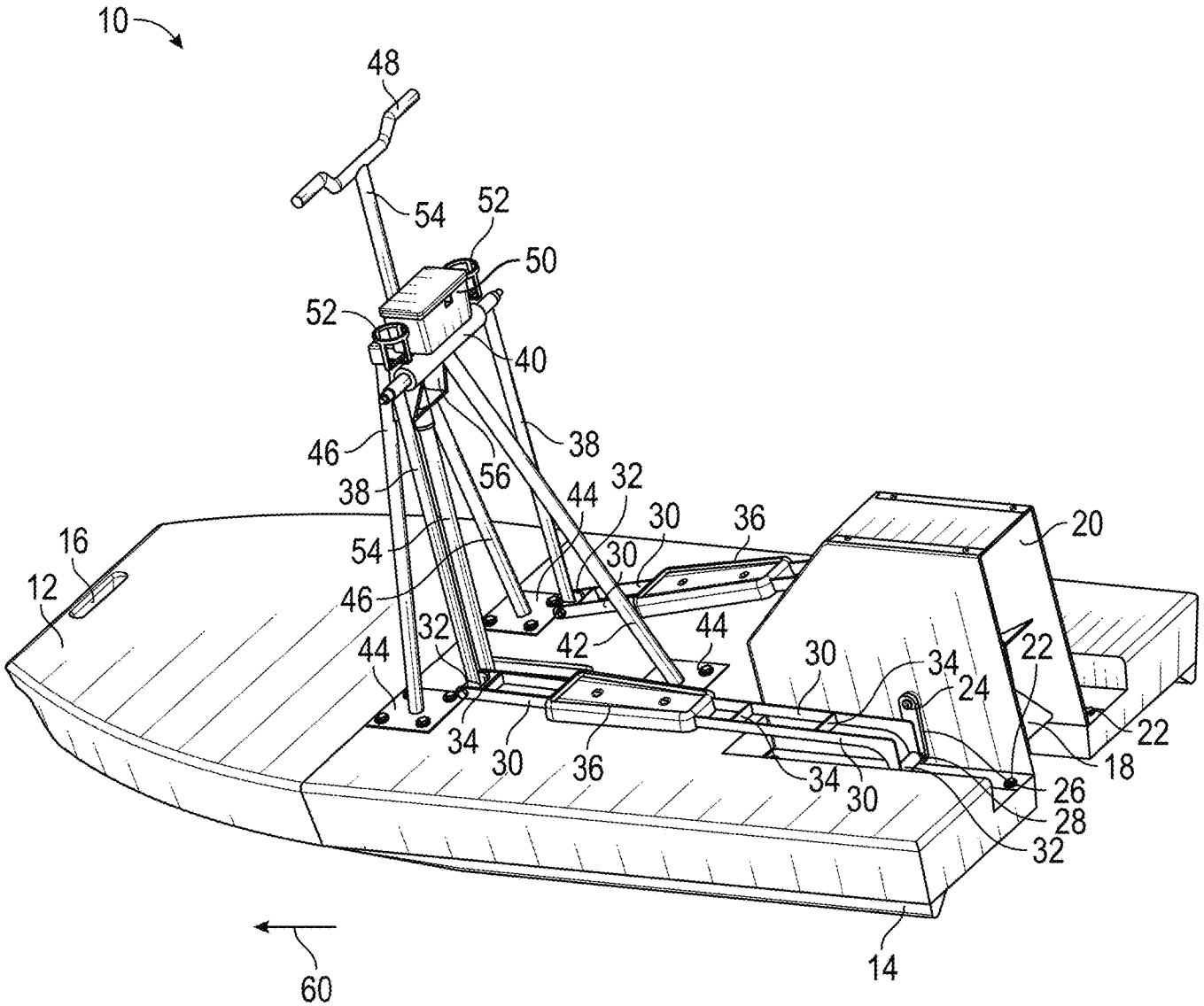
FIG. 1 shows a perspective view of an elliptical powered watercraft, according to some aspects of the present disclosure.

Several embodiments in which the present invention may be practiced are illustrated and described in detail, wherein like reference numerals represent like components throughout the several views. The drawings are presented for exemplary purposes and may not be to scale, unless otherwise indicated, and thus proportions of features in the drawings shall not be construed as evidence of actual proportions.

DETAILED DESCRIPTION OF THE INVENTION

Definitions—Introductory Matters

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include both singular and plural referents.

The term "or" is synonymous with "and/or" and means any one member or combination of members of a particular list.

The terms "invention" or "present invention" as used herein are not intended to refer to any single embodiment of the particular invention but encompass all possible embodiments as described in the specification and the claims.

The term "about" as used herein refers to slight variations in numerical quantities with respect to any quantifiable variable. One of ordinary skill in the art will recognize inadvertent error can occur, for example, through use of typical measuring techniques or equipment or from differences in the manufacture, source, or purity of components. The claims include equivalents to the quantities whether or not modified by the term "about."

The term "configured" describes an apparatus, system, or other structure that is constructed to perform or capable of performing a particular task or to adopt a particular configuration. The term "configured" can be used interchangeably with other similar phrases such as constructed, arranged, adapted, manufactured, and the like.

Terms characterizing a sequential order (e.g., first, second, etc.), a position (e.g., top, bottom, sides, forward, aft, etc.), and/or an orientation (e.g., width, length, depth, thickness, vertical, horizontal, etc.) are referenced according to the views presented. Unless context indicates otherwise, these terms are not limiting. The physical configuration of an object or combination of objects may change without departing from the scope of the present invention.

As would be apparent to one of ordinary skill in the art, mechanical, procedural, or other changes may be made without departing from the spirit and scope of the invention. The scope of the invention is defined only by the appended claims, along with the full scope of equivalents to which such claims are entitled.

Overview

Referring now to the figures, FIGS. 1-5 show an elliptical powered watercraft 10 having a buoyant platform 12. The platform's buoyancy, or ability to float, comes from its density and from surface tension created by molecules that make up water. The buoyant platform 12 is less dense than the water underneath it. The coating of the buoyant platform 12 is also waterproof, keeping water from seeping in, soaking the inside of the material of the buoyant platform 12 and pulling the buoyant platform 12 under. The buoyant platform 12 includes an upper surface or a deck, a lower surface or a hull, a forward portion or a bow, a central portion or an amidships, an aft portion or a stern, a starboard (left-hand) side, and a port (right-hand) side.

When placed in and submerged by water, the portion of the lower surface or the hull below the waterline may be referred to as the bilge.

To prevent an operator from falling forward and to nullify rough water or wakes, the forward portion or the bow of the buoyant platform 12 may be raised further above the waterline.

To prevent the buoyant platform 12 from flipping or tipping and to facilitate movement through the water, the buoyant platform 12 may include strakes, stringers, or ridges 14. Strakes or stringers 14 are part of the shell of the hull or the lower surface of the buoyant platform 12 which, in conjunction with the other strakes, keeps the vessel watertight and afloat. Each strake 14 may comprise a strip of wooden planking or a metal plating running longitudinally along port and starboard sides of the buoyant platform 12, the hull or the lower surface, usually from one end of the elliptical powered watercraft 10 to the other. For example, the embodiment illustrated in the figures includes two strakes 14 where the hull or the lower surface meets the port and starboard sides of the buoyant platform 12. Stringers 14 run horizontally along the hull or the lower surface of the buoyant platform 12 providing structural strength to the elliptical powered watercraft 10. Each strake or stringer 14 may comprise numerous planks joined together and running from end to end.

To prevent water from becoming trapped on the deck or the upper surface of the buoyant platform 12, a scupper 16 or several scuppers may be included to drain water from the deck or the upper surface. Scuppers 16 are essentially just openings in the side walls of an open-air structure. They are usually placed at or near ground level and allow rain or liquids to flow off the side or below the open-air structure, instead of pooling within the walls or on the deck. As shown in the figures, a scupper 16 is typically included at a forwardmost and raised portion of the bow. However, scuppers may also be located in the port and starboard sides of the buoyant platform 12.

Located at the aft portion or the stern, a paddle wheel 18 acts as a form of waterwheel or impeller in which a number of paddles are set around the periphery of the wheel. The paddle wheel 18 is a device for converting rotary motion of a shaft into linear motion (rotary-to-linear direction) through a fluid such as water. For example, in order for the buoyant platform 12 to travel in a forward direction, the individual paddles of the paddle wheel 18 are driven by a rotating shaft, will rotate and push water rearward. If traveling fast enough, water will also be pushed in an upward direction at an aft most portion of the paddle wheel 18 thereby creating a wake with a vertical protrusion, similar to a rooster tail.

In the, the paddle wheel 18 is driven by a prime mover such as pedal-driven crank to propel the elliptical powered watercraft 10. The paddle wheel 18 may be substituted or in used in combination with other propellers, such as a marine propeller (screw propeller) having fixed helical blades rotating around a nearly horizontal axis or propeller shaft, controllable-pitch propellers, skewback propellers, modular propellers, Voith Schneider propellers, a cleaver, maneuvering thrusters, or the like. For these types of propellers, pressure differences produced between the forward and rear surfaces of the airfoil-shaped blade and accelerates water behind the blade to propel the desired direction. Propeller dynamics, like those of aircraft wings, can be modelled by Bernoulli's principle and Newton's third law.

In a preferred embodiment, a housing 20 protects the paddle wheel 18 from external debris and simultaneously protects an operator from injury due to contacting the paddle wheel 18 during operation of the elliptical powered watercraft 10. The housing 20 may comprise a hemispherical shell, a polygonal prism, or the like and may comprise metal, metal alloy, plastic, fiberglass, or any other known material of sufficient strength to protect the paddle wheel 18 from external debris and to protect an operator from injury due to contacting the paddle wheel 18 during operation of the elliptical powered watercraft 10. The housing 20 may be secured to the aft portion or the stern of the buoyant platform 12 via mounting brackets 22 and fasteners, such as screws, nuts, bolts, rivets, washers, any other known fasteners, or any combination thereof.

The paddle wheel 18 is driven by a shaft passing through the center of the paddle wheel 18 and having two ends culminating at first pivot points 24. There are two first pivot points 24, a starboard first pivot point and a port first pivot point. The first pivot points 24 are operatively attached to cranks 26 which are operatively attached to second pivot points 26. The second pivot points are operatively attached to the pedals 36.

During operation (pedaling) of the elliptical powered watercraft 10, an operator balances on the buoyant platform 12 and generates rotational movement with the pedals 36 to deliver power to the paddle wheel 18. The first pivot points 24 allow the cranks 26 to rotate 360° around the first pivot points 24 similar to how a blade of a wind turbine rotates around a hub of the wind turbine. The second pivot points 28 allow the pedals 36 to stay substantially parallel with the buoyant platform 12 during rotation of the cranks 26 such that an operator can pedal in an elliptical motion.

To help reduce the risk of injury to an operator while operating the elliptical powered watercraft 10 and/or while swimming near the elliptical powered watercraft, the pedals 36 and/or the platform 12 may comprise non-slip surfaces. For example, the pedals 36 and/or the platform 12 can be made from a non-slip material such as a rigid textured plastic, foam, rubber, or combination thereof. Alternatively, a non-slip substance or coating (e.g., an adhesive) can be applied to slippery surfaces (e.g., fiberglass) of the pedals 36 and/or the platform 12.

Additional safety elements can be used or accompany the elliptical powered watercraft 10, including, but not-limited to: a vehicle horn, life saving flotation devices (e.g., a life jacket), ropes and/or straps which can secure an object or an operator to a portion of the elliptical powered watercraft 10, edge protectors for corners of the platform 12, means for notifying emergency service providers of an emergency, and the like.

More particularly, the pedals 36 are part of larger "ski assemblies" which essentially include two side plates or stride rails 30 running from the second pivot points 28 to the pedals 36 and from the pedals 36 to the pedal tubes 38. The side plates or stride rails 30 are adjoined via several linkages, include more robust forward and aft linkages 32 and less robust central linkages 34. Alternative embodiments to the embodiment shown in the figures include each side plate 30 running from the second pivot points 28 through the pedals 36 and directly to the pedal tubes 38 or even having some or all of the pedals 36, side plates or stride rails 30, forward and aft linkages 32, and central linkages 34 comprise a singular solid member or ski.

Figure 2:
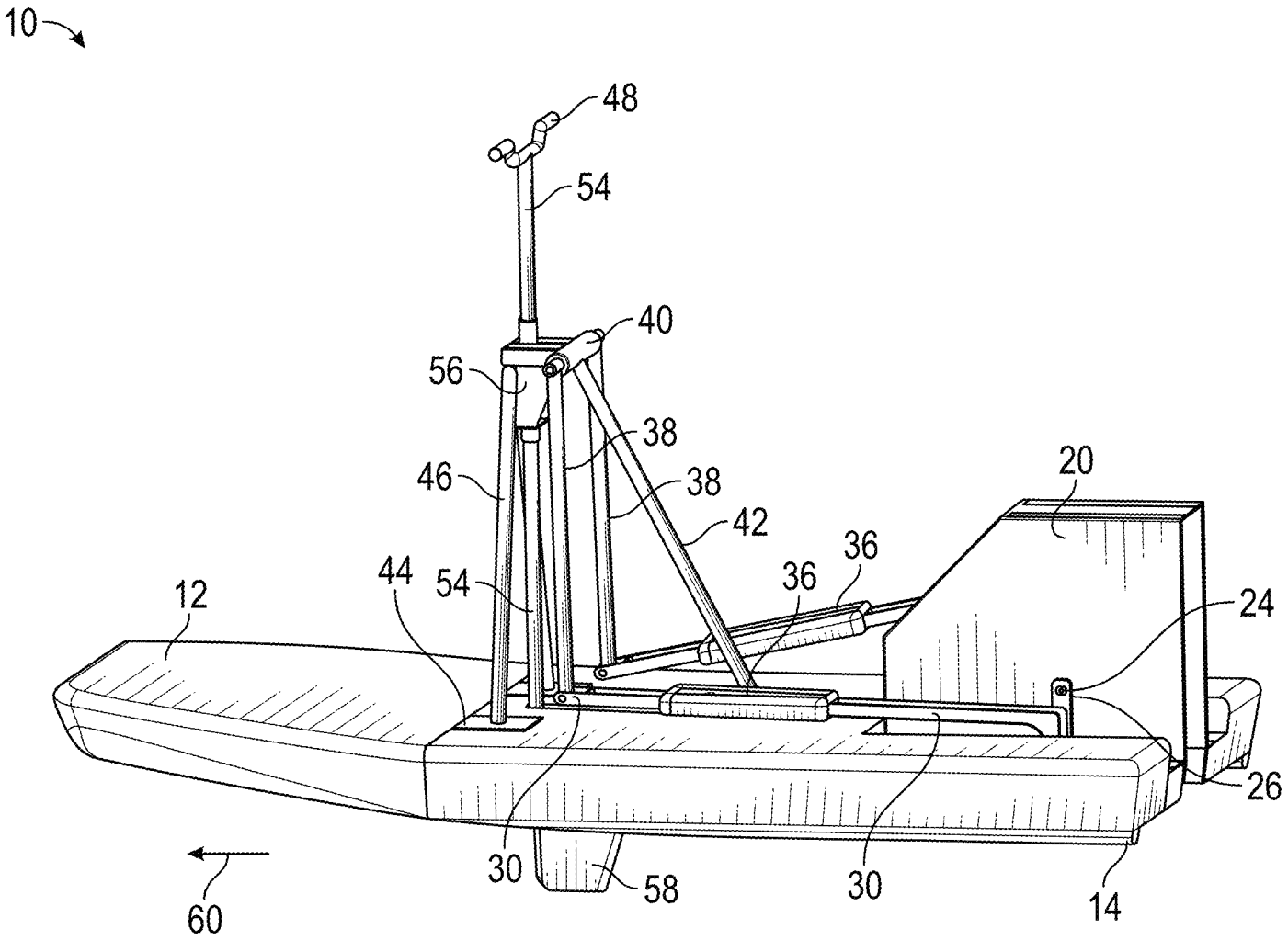
FIG. 2 shows another perspective view of an elliptical powered watercraft, according to some aspects of the present disclosure.
Figure 3:
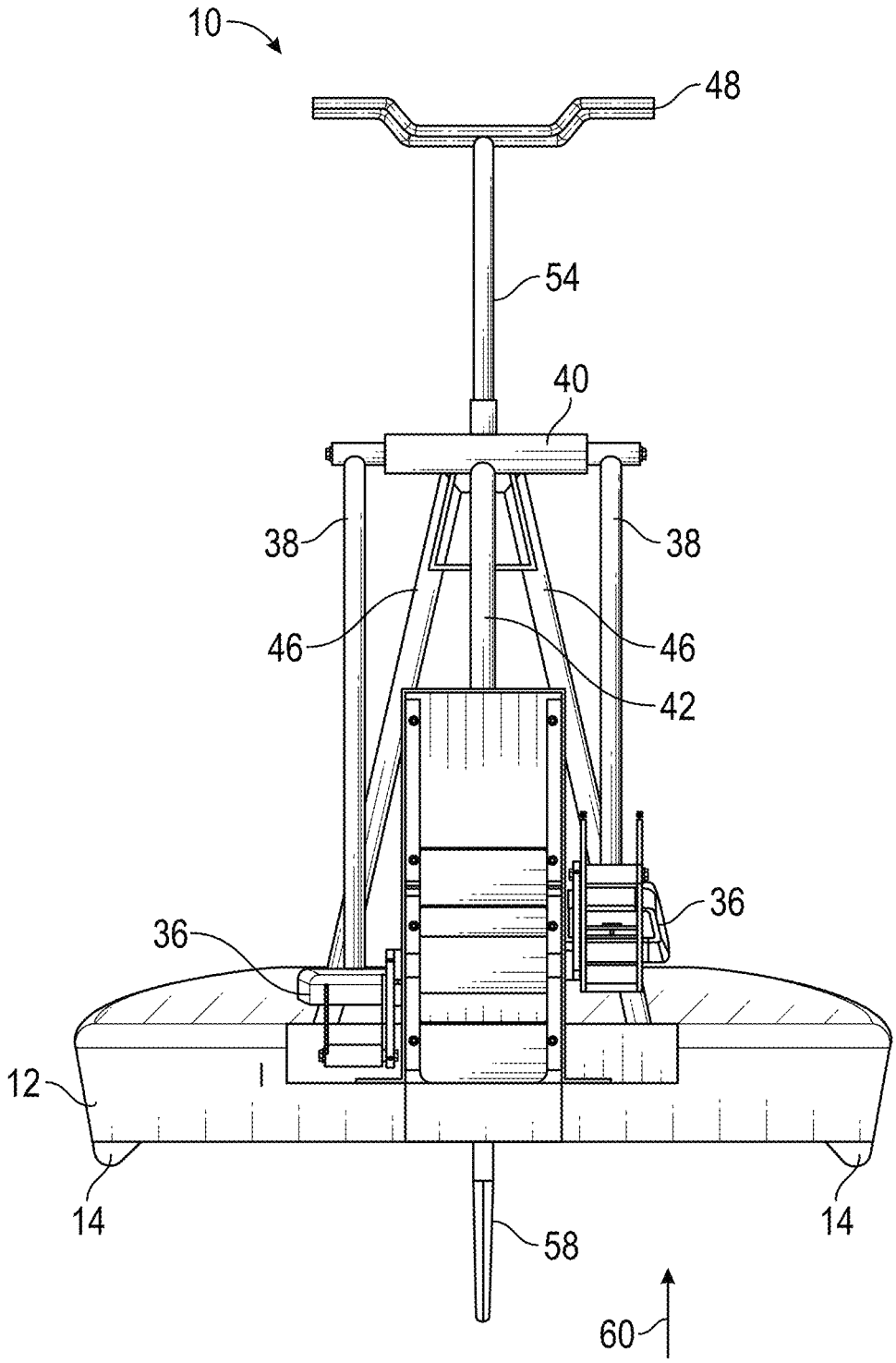
FIG. 3 shows a rear elevation view of an elliptical powered watercraft, according to some aspects of the present disclosure.
Figure 4:
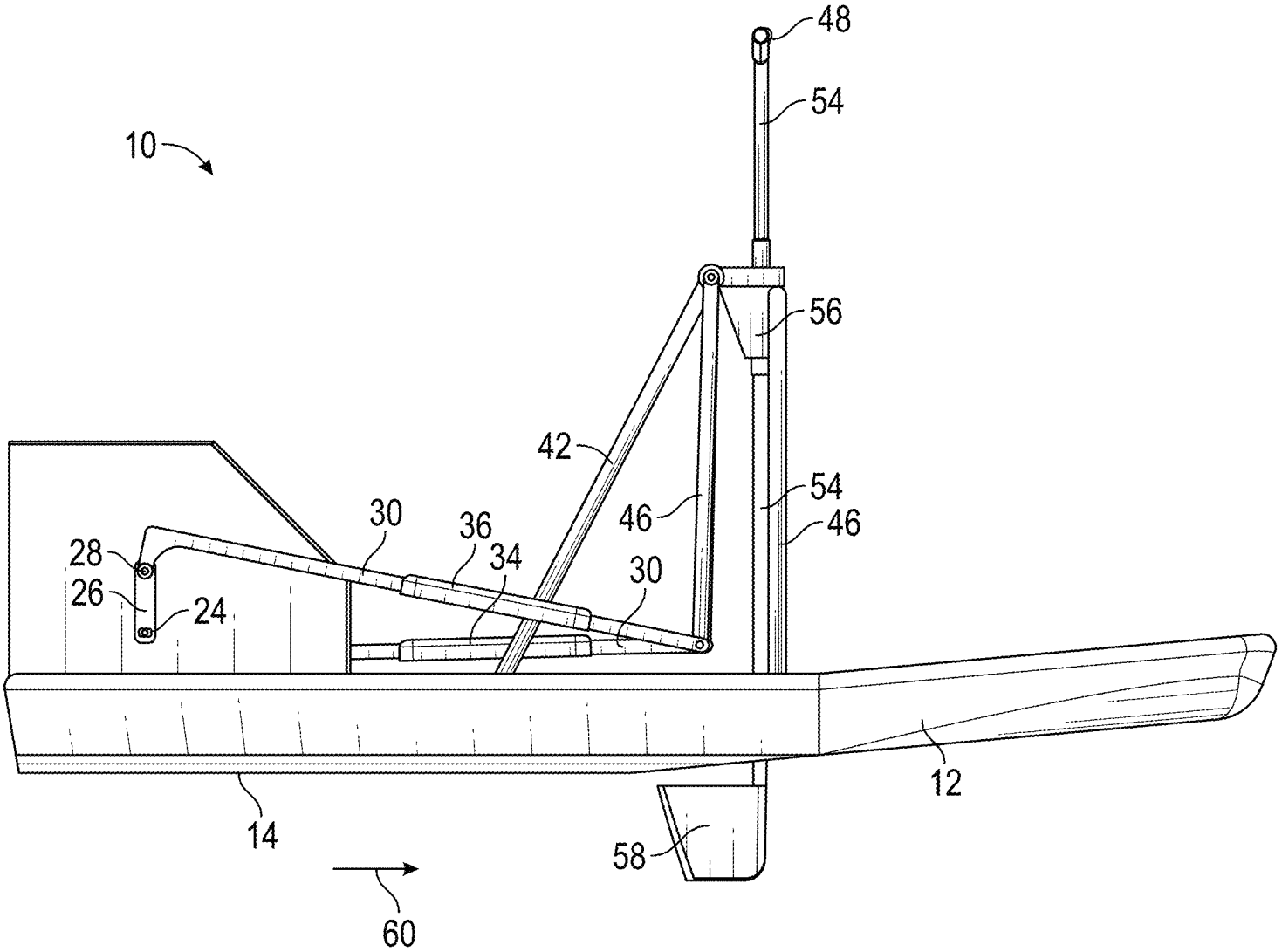
FIG. 4 shows a side elevation view of an elliptical powered watercraft, according to some aspects of the present disclosure.
Figure 5:
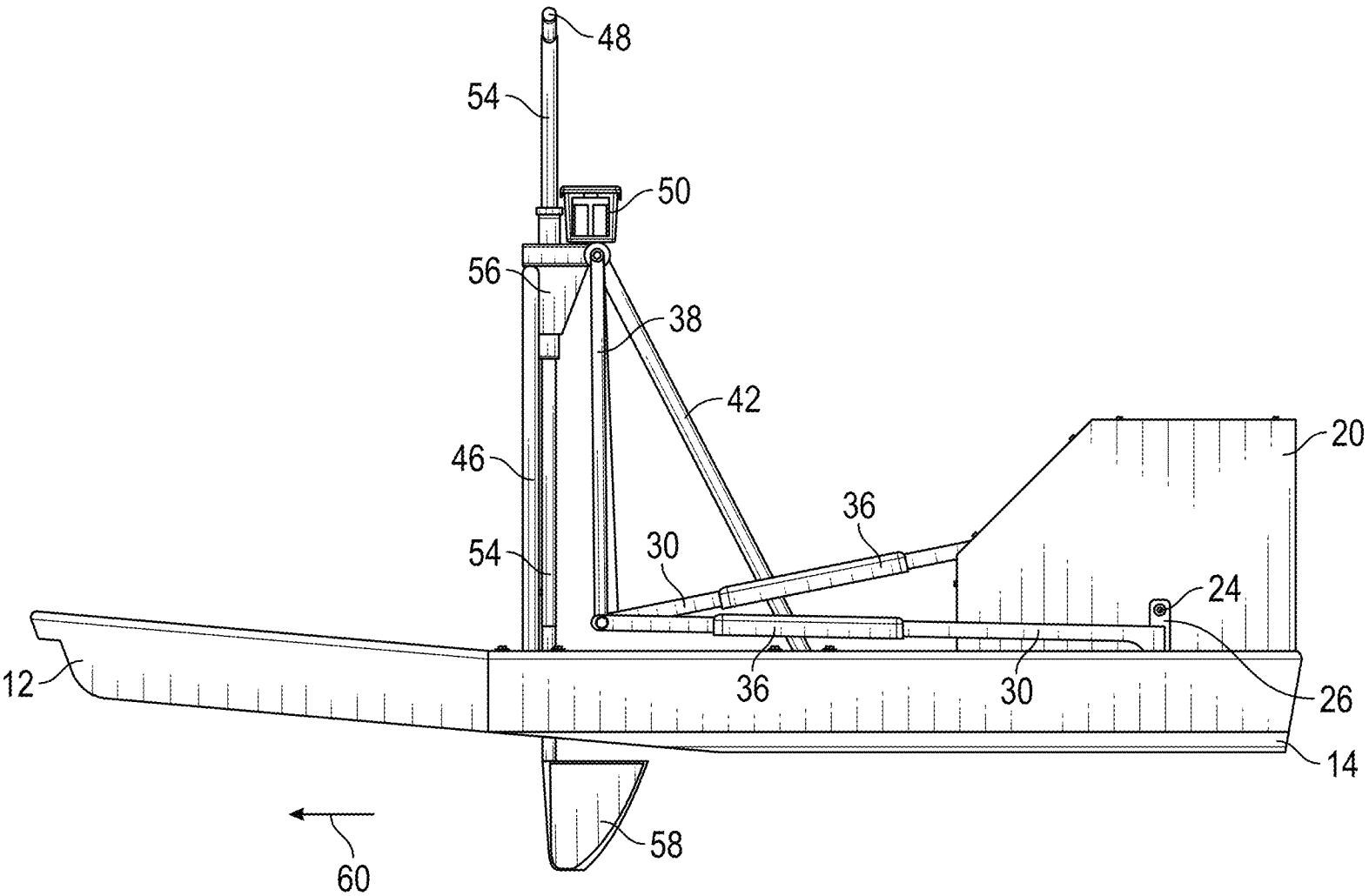
FIG. 5 shows an opposite side elevation view of an elliptical powered watercraft, according to some aspects of the present disclosure.

The crank 26 shown in FIGS. 1, 2, and 5 is in a downright position, which occurs when the corresponding pedal 36 is at the lowest point in its elliptical motion. The crank 26 shown in FIG. 4 is in an upright position, which occurs when the corresponding pedal 36 is at the highest point in its elliptical motion. Similarly, the crank 26 is in an aftmost position when the corresponding pedal 36 is at the aftmost point in its elliptical motion and the crank 26 is in a forwardmost position when the corresponding pedal 36 is at the forwardmost point in its elliptical motion. In a preferred embodiment, the pedals 36 are parallel to the buoyant platform 12 when at the pedals 36 are in the lowest position and the pedals 36 are angled substantially downward such that an operator is on the ball of his or her foot when the pedals 36 are in the highest position.

The cranks 26 and side plates or stride rails 30 may vary in length to accommodate different sized operators and different types of ellipticals. Depending on the embodiment of the water powered elliptical 10, the cranks 26 and side plates or stride rails 30 could even be adjusted to different lengths after manufacturing. While logic would suggest that, all other things being equal, operators with shorter legs should use proportionally shorter cranks 26 or side plates or stride rails 30 and those with longer legs should use proportionally longer cranks 26 or side plates or stride rails 30, this is not universally accepted and it may depend on operator preference. This is because few scientific studies have definitively examined the effect of crank length on sustained exercise and the studies' results have been mixed. Bicycle crank length, for example, has not been easy to study scientifically for a number of reasons, chief among them being that cyclists are able to physiologically adapt to different crank lengths. Cyclists are typically more efficient pedaling cranks with which they have had an adaptation period. Several different formulas exist to calculate appropriate crank length for various riders. In addition to the operator's size, another factor affecting the selection of crank length is the rider's fitness level and the type of exercise. In a further historical example, bicycle riders have typically chosen proportionally shorter cranks for higher cadence cycling such as criterium and track racing, while other riders have chosen proportionally longer cranks for lower cadence cycling such as time trial racing and mountain biking. However, the evolution of very low rider torso positions to reduce aerodynamic drag for time trial racing and triathlon cycling can also affect crank selection for such events. Some have suggested that proportionally shorter cranks may have a slight advantage for a rider with a very low torso position and an acute hip angle, especially as the rider pedals near the top-dead-center position of the pedal stroke. The cranks 26 can be shortened for medical reasons using shorteners.

The elliptical powered watercraft 10 as shown in the figures comprises a frame including the steering mechanism 48, a main tube 54 operatively attached to the steering mechanism 48 and a skeg, a fin, or a rudder 58, and a lower tube 42 supporting the main tube. The lower tube 42 supporting the main tube 54 is secured via a mounting plate 44 and known fasteners to the central portion or the amidships of the buoyant platform 12 and is angled forward.

In some embodiments, the lower tube 42 attaches to an upper tube 40 and essentially bisects the upper tube 40. The upper tube 40 includes port and starboard ends which fix the upper ends of the pedal tubes 38 and serves as one of the components connecting the frame of the elliptical powered watercraft 10 and the pedals 36. Forward tubes 46 support the main tube 54 in a lateral direction. The forward tubes 46 are secured near the intersection of the central portion or the amidships and the raised, forward portion or the bow of the buoyant platform 12 via mounting plates 44 and any known fasteners.

A support structure 56, such as an open metal polygonal prism or a truss attaches to the forward tubes, the main tube, and the upper tube to provide further support to the frame of the elliptical powered watercraft 10.

The elliptical powered watercraft 10 may also provide various means of storing objects including a watertight storage compartment 50, a tackle box, or a well. The watertight storage compartment 50 may act as a safe and include a means for locking and storing personal belongings during operation of the elliptical powered watercraft 10. The storage compartment 50 may be located anywhere on the elliptical powered watercraft 10 although the figures show the storage compartment 50 being located right above the upper tube 40. The storage compartment 50 may be sized large enough to store life jackets, rope, anchors, etc. A tackle box may be substituted for or placed within the watertight storage compartment 50 and allows an operator to remove bait, lures, fishing line, or any other small items that are useful for catching a fish or the enjoyment of fishing. In some embodiments, once an operator catches a fish, the fish can be stored within a well that is included on the elliptical powered watercraft 10. In other embodiments, included near the watertight storage compartment 50 are cupholders 52 allowing an operator to store a bottle, a cup, a mug, glassware or any other type of beverage holder during operation of the elliptical powered watercraft 10. In still other embodiments, the leisure of the operator may be improved from the inclusion of a seat. This may particularly useful if the operator intends to fish. In these embodiments, the elliptical powered watercraft 10 may be used by an operator while the operator is sitting or in an upright position.

The elliptical powered watercraft 10 may be adapted to accommodate more than one operator. In such an embodiment, at least a second operator may help generate rotational movement another set of pedals 36 to deliver power to the paddle wheel 18. Even further, some embodiments may include more than one paddle wheel 18.

When not being used for leisure or for exercise, the elliptical powered watercraft 10 may be transported from one location to another more easily if the elliptical powered watercraft 10 includes wheels or tires or the elliptical powered watercraft 10 may be stored in shelter (e.g., during the winter).

The main tube 54 is fastened to a rudder, fin, or skeg 58 and passes through an aperture or slot at the central portion or an amidships of the buoyant platform 12. When the elliptical powered watercraft 10 is not in use, the rudder, fin, or skeg 58 and the main tube 54 may slide up through the aperture such that they can be removed from the elliptical powered watercraft 10 for easier storage.

In recent years, the term skeg has been used for a fin on a surfboard which improves directional stability and to a movable fin on a kayak which adjusts the boat's center of lateral resistance. The term is also often used for the fin on water skis in the United States and for the tail bumpers of aircraft in the United States Navy. The rudder, fin, or skeg 58 of the elliptical powered watercraft 10 is the primary control surface used to steer the elliptical powered watercraft 10 through a fluid medium. The rudder, fin, or skeg 58 operates by redirecting water past the hull or the lower surface of the platform 12, thus imparting a turning or yawing motion to the elliptical powered watercraft 10 and slightly altering the direction of travel 60. In basic form, the rudder, fin, or skeg 58 is a flat plane or sheet of material attached with hinges to the watercraft's stern, tail, or after end. Often the rudder, fin, or skeg 58 is shaped so as to minimize hydrodynamic drag. The steering mechanism 48, such as handlebars or even a stick or pole acting as a lever arm, may be mechanically attached to the top of the rudder, fin, or skeg 58 to allow it to be turned by an operator. However, for larger or heavier elliptical powered watercraft, cables, pushrods, or hydraulics may be used to link the rudder, fin, or skeg 58 to a steering wheel.

The direction of travel 60 may be reversed if an operator pedals backwards, such as in a fixed gear bicycle (clockwise if viewing, from an external location, the port side of the elliptical powered watercraft 10 and counterclockwise if viewing, from an external location, the starboard side of the elliptical powered watercraft 10). However, a freewheel, freehub, or overrunning clutch may be utilized that incorporates a ratcheting mechanism and disengages the driveshaft from the driven shaft when the driven shaft rotates in reverse or rotates faster than the driveshaft.

In some embodiments, the elliptical powered watercraft 10 includes an engine or motor as an alternative way to power the paddle wheel 18. An engine or motor may be desired if the operator is concerned about fatigue or getting stranded at sea. The engine or motor typically may include an emergency stop feature, also known as a "kill switch," to shut off the motor in an emergency or any other safety mechanisms known to prevent injury to users of the motor. The emergency stop feature or other safety mechanisms may need user input or may use automatic sensors to detect and determine when to take a specific course of action for safety purposes (e.g., shutting the motor down if a sensor determines something is caught in the motor).

The engine or motor is designed to convert one form of energy into mechanical energy. Potential nonlimiting examples of engines or motors include external combustion engines (e.g., steam engines), internal combustion engines (e.g., gas engines), air-breathing combustion engines (e.g., jet turbine engines), an electric motor (e.g., DC motors, AC motors, self-commutated-motors including brushed and brushless DC motors), a physically powered motor, a pneumatic motor, a hydraulic motor, or the like. The engine or motor may be run at multiple speeds and various motor parameters including, but not limited to, power consumption, speed, thrust, torque, motor phase current, motor back EMF, engine noise or the like to achieve a practical affect consistent with the objects of the present disclosure. These parameters may be calculated, monitored, and saved by an intelligent control associated with the motor so that efficiencies are gained when using the engine or motor for standard or repetitive tasks.

An input from a user interface ("UI") can be sent to a microcontroller to control operational aspects of a device and could include a combination of digital and analog input and/or output devices or any other type of UI input/output device required to achieve a desired level of control and monitoring for a device. A user interface can be how the user interacts with the elliptical powered watercraft 10, and could be a digital interface, a command-line interface, a graphical user interface ("GUI") or any other way a user can interact with a machine. For example, the user interface module can include a display and input devices such as a touch-screen, knobs, dials, switches, buttons, etc. More specifically, the display could be a liquid crystal display ("LCD"), a light-emitting diode ("LED") display, an organic LED ("OLED") display, an electroluminescent display ("ELD"), a surface-conduction electron emitter display ("SED"), a field-emission display ("FED"), a thin-film transistor ("TFT") LCD, a bistable cholesteric reflective display (i.e., e-paper), etc. The user interface also can be configured with a microcontroller to display conditions or data associated with the main device in real-time or substantially real-time.

For example, the user interface could be used to set a higher resistance level in the pedals 36 of the elliptical so that the operator burns more calories during exercise. The user interface could also show the operator the "distance" the operator has traveled, as is common in treadmills and ellipticals of commercial fitness centers.

The user interface may also allow the operator of the water powered elliptical to connect to the Internet by accessing a network. In some embodiments, the network is, by way of example only, a wide area network ("WAN") such as a TCP/IP based network or a cellular network, a local area network ("LAN"), a neighborhood area network ("NAN"), a home area network ("HAN"), or a personal area network ("PAN") employing any of a variety of communications protocols, such as Wi-Fi, Bluetooth, ZigBee, near field communication ("NFC"), etc., although other types of networks are possible and are contemplated herein. The network typically allows communication between the communications module and the central location during moments of low-quality connections. Communications through the network can be protected using one or more encryption techniques, such as those techniques provided in the IEEE 802.1 standard for port-based network security, pre-shared key, Extensible Authentication Protocol ("EAP"), Wired Equivalent Privacy ("WEP"), Temporal Key Integrity Protocol ("TKIP"), Wi-Fi Protected Access ("WPA"), and the like.

In some embodiments, the elliptical powered watercraft 10 includes one or more communications ports such as Ethernet, serial advanced technology attachment ("SATA"), universal serial bus ("USB"), or integrated drive electronics ("IDE"), for transferring, receiving, or storing data.

In some embodiments, the elliptical powered watercraft 10 includes the use of a satellite-based radio-navigation system such as the global positioning system ("GPS"). GPS is owned by the United States and uses satellites to provide geolocation information to a GPS receiver. GPS, and other satellite-based radio-navigation systems, can be used for location positioning, navigation, tracking, and mapping.

Artificial lighting or light fixtures may be implemented within the elliptical powered watercraft 10 to achieve a practical or aesthetic affect consistent with the objects of the present disclosure, such as illuminating an area for visibility or for warning others about a potential hazard. Nonlimiting examples of artificial lighting include incandescent lamps, halogen lamps, parabolic aluminized reflector lamps, fluorescent lamps, electrodeless or induction lamps, laser lamps, light emitting diode ("LED") lamps, electron-stimulated luminescence lamps, combustion-based lamps (e.g. gas lamps, oil lamps), arc lamps, gas discharge lamps, and high-intensity discharge (HID) lamps. These lamps may be used as headlights, brake lights or tail lights, reverse lights, turn signals, etc. to improve the In a preferred embodiment, the elliptical powered watercraft 10 includes LEDs which illuminate a starboard side of the buoyant platform with the color green, a port side of the buoyant platform with the color red, and an aft portion or stern of the buoyant platform with the color white. Additionally, artificial lighting may be included to illuminate the storage compartment 50, the tackle box, or the well of the elliptical powered watercraft.

The elliptical powered watercraft 10 may also include sensors to sense one or more characteristics of an object and can include, for example, accelerometers, position sensors, fluid level sensors, or depth sensors among many others. The accelerometers can sense acceleration of an object in a variety of directions (e.g., an x-direction, a y-direction, etc.). The position sensors can sense the position of one or more components of an object. For example, the position sensors can sense the position of an object relative to another fixed object such as a wall. The fluid level sensors can sense a measurement of fluid contained in a container. The depth sensors can sense how deep the water is directly below the elliptical powered watercraft 10. Fewer or more sensors can be provided as desired. For example, a rotational sensor can be used to detect speed(s) of object(s), motion or distance sensors can be used to detect the distance an object has traveled, one or more timers can be used for detecting a length of time an object has been used and/or the length of time any component has been used, and temperature sensors can be used to detect the temperature of an object or fluid.

From the foregoing, it can be seen that the present invention accomplishes at least all of the stated objectives.

LIST OF REFERENCE NUMERALS

The following reference numerals and descriptors are not exhaustive, nor limiting, and include reasonable equivalents. If possible, elements identified by a reference numeral may replace or supplement any element identified by another reference numeral.

10 elliptical powered watercraft
12 platform
14 strake, stringer, or ridge
16 scupper
18 paddle wheel or water wheel propeller
20 housing
22 mounting brackets
24 first pivot point
26 crank
28 second pivot point
30 side plates or stride rails
32 aft and forward bridge linkages
34 central bridge linkages
36 pedals or foot pads
38 pedal tubes
40 upper tube
42 lower tube
44 mounting plates
46 forward tubes
48 steering mechanism
50 storage compartment
52 cup holder
54 main tube
56 support structure for the frame

58 skeg, fin, or rudder
60 direction of travel

The present disclosure is not to be limited to the particular embodiments described herein. The following claims set forth a number of the embodiments of the present disclosure with greater particularity.

What is claimed is:

1. An elliptical powered watercraft comprising:
a buoyant platform;
a paddle wheel;
pedals operatively connected to the paddle wheel; and
a skeg, a fin, or a rudder operatively connected to a steering device;
a frame comprising:
the steering device;
a main tube operatively attached to the steering device and the skeg, the fin, or the rudder; and
a lower tube supporting the main tube;
pedal tubes with upper and lower ends, said lower ends operatively attached to the pedals and said upper ends fixed at a location on the frame.

2. The elliptical powered watercraft of claim 1 further comprising a housing encompassing the paddle wheel.

3. The elliptical powered watercraft of claim 1 wherein the frame further comprises:
an upper tube attached to the lower tube, said upper tube having port and starboard ends which fix the upper ends of the pedal tubes; and
forward tubes supporting the main tube.

4. The elliptical powered watercraft of claim 3 further comprising mounting plates bolted to the buoyant platform, said mounting plates securing the lower tube and the forward tubes to the buoyant platform.

5. The elliptical powered watercraft of claim 3 further comprising a support structure attached to the forward tubes, the main tube, and the upper tube.

6. The elliptical powered watercraft of claim 1 further comprising:
side plates or stride rails attached to the pedals and the pedal tubes; and
aft, central, and forward bridge linkages adjoining the side plates or stride rails.

7. The elliptical powered watercraft of claim 1 further comprising:
a first pivot point associated with the paddle wheel;
a second pivot point associated with the pedals; and
a crank adjoining the first pivot point and second pivot point and translating kinematic movement from the pedals into rotational movement for the paddle wheel.

8. The elliptical powered watercraft of claim 1 further comprising a watertight storage compartment, a tackle box, or a well.

9. The elliptical powered watercraft of claim 1 further comprising a seat and a cup holder.

10. The elliptical powered watercraft of claim 1 further comprising wheels.

11. A method of propelling the elliptical powered watercraft of claim 1, the method comprising:
balancing on the buoyant platform;
generating rotational movement with the pedals to deliver power to the paddle wheel; and
steering the elliptical powered watercraft by turning the skeg, the fin, or the rudder with the steering device.

12. The method of propelling the elliptical powered watercraft of claim 11 further comprising adjusting a level of resistance in the pedals.

13. The method of claim 11 further comprising resisting tipping or flipping of the buoyant platform with strakes, said strakes located where a hull or lower surface meets port and starboard sides of the buoyant platform.

14. The method of claim 11 further comprising nullifying rough water or wakes with a raised forward portion or bow of the buoyant platform.

15. The method of claim 11 further comprising changing a direction of travel by pedaling backwards.

16. The method of claim 11 further comprising draining water trapped on a deck or an upper surface of the buoyant platform with a scupper.

17. The method of claim 11 further comprising illuminating with lights:
water surrounding the elliptical powered watercraft;
a starboard side of the buoyant platform with a green color, a port side of the buoyant platform with a red color, and an aft portion or stern of the buoyant platform with a white color; or
a storage compartment, a tackle box, or a well of the elliptical powered watercraft.

18. The method of claim 11 further comprising configuring the elliptical powered watercraft such that more than one operator can generate rotational movement with the pedals to deliver power to the paddle wheel.

* * * * *